US007695059B1

(12) United States Patent
May

(10) Patent No.: US 7,695,059 B1
(45) Date of Patent: Apr. 13, 2010

(54) ADJUSTABLE LEG REST ASSEMBLY

(75) Inventor: Teddy May, Mooreville, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 780 days.

(21) Appl. No.: 11/402,722

(22) Filed: Apr. 12, 2006

Related U.S. Application Data

(60) Provisional application No. 60/670,388, filed on Apr. 12, 2005.

(51) Int. Cl.
*A47C 1/02* (2006.01)
*A47C 7/50* (2006.01)

(52) U.S. Cl. ..... 297/69; 297/423.26

(58) Field of Classification Search ..... 297/85, 297/423.26, 84, 85 R, 69, 89
See application file for complete search history.

(56) References Cited

U.S. PATENT DOCUMENTS

| | | | | | |
|---|---|---|---|---|---|
| 403,318 | A | | 5/1889 | Arnold | |
| 639,076 | A | | 12/1899 | May | |
| 3,695,701 | A | | 10/1972 | Knabusch et al. | |
| 3,781,060 | A | * | 12/1973 | Pentzien | 297/68 |
| 3,794,381 | A | | 2/1974 | Caldemeyer | |
| 3,869,169 | A | | 3/1975 | Johnson et al. | |
| 3,904,240 | A | * | 9/1975 | Rogers et al. | 297/85 |
| 4,212,495 | A | | 7/1980 | Gall | |
| 4,365,836 | A | * | 12/1982 | Jackson et al. | 297/85 |
| 4,408,796 | A | | 10/1983 | Mizelle | |
| 4,508,387 | A | | 4/1985 | Gilbert et al. | |
| 4,509,795 | A | | 4/1985 | Brennan et al. | |
| 4,621,863 | A | * | 11/1986 | Jackson et al. | 297/85 |
| 4,718,716 | A | | 1/1988 | Stumpf et al. | |
| 5,352,020 | A | | 10/1994 | Wade et al. | |
| 5,597,210 | A | | 1/1997 | Pickard | |
| 5,800,010 | A | * | 9/1998 | May | 297/85 |
| 5,845,961 | A | | 12/1998 | LaPointe et al. | |
| 5,918,942 | A | | 7/1999 | Olsen | |
| 6,095,610 | A | | 8/2000 | Okajima et al. | |
| 6,382,727 | B1 | | 5/2002 | Pickard | |
| 6,517,160 | B2 | | 2/2003 | Marcantoni | |
| 6,659,562 | B2 | | 12/2003 | Uchiyama | |

* cited by examiner

*Primary Examiner*—Milton Nelson, Jr.
(74) *Attorney, Agent, or Firm*—Bradley Arant Boult Cummings, LLP

(57) ABSTRACT

An adjustable leg rest assembly for use with a chair (such as a reclining chair) is described. The adjustable leg assembly supports a foot rest pad and is capable of alternating between a first position (where the foot rest pad is closer to the front of the reclining chair) and a second position (where the foot rest pad is farther away from the front of the chair) to adjust to the physical characteristics of a user of the chair. A pair of retractable scissor linkages supports the adjustable leg rest assembly. The scissor linkages are pivotally secured to the adjustable foot rest on one end thereof and are moveably secured to the chair on the other end thereof as is known in the art.

18 Claims, 6 Drawing Sheets

ADJUSTABLE LEG REST ASSEMBLY

This Application claims priority to and benefit of U.S. Provisional Application No. 60,670,388, filed Apr. 12, 2005.

FIELD OF THE DISCLOSURE

The present disclosure relates to an adjustable leg rest assembly for use with a chair.

BACKGROUND OF THE DISCLOSURE

As is known in the art, the provision of a leg rest in combination with a reclining chair offers the user of the chair additional support for the legs of the user. The leg rest should be positioned so as to support the calves and feet of the user to provide maximum comfort and support. In many prior art reclining chairs the foot rest is not adjustable (i.e. the leg rest was static). While useful, such static leg rests have a significant disadvantage in that the leg rest cannot be adjusted to account for the different physical characteristics of a user. Such physical characteristics of a user include, but are not limited to, the height of the user and the leg length of a user.

It is common in the industry when such a static leg rest is used to position the leg rest in a fixed position such that is in an optimal placement to benefit a user with average physical characteristics. Such average physical characteristics can be determined from publicly available databases. However, certain average physical characteristics may differ depending on the gender of a user (for example, males tend to have a greater average height than females). For instance, if the static leg rest is position on the reclining chair to be in an optimal position for a person of average height, the leg rest will not be in an optimal position for a person whose height is greater than or less than the average height. In these cases, the foot rest is positioned so the calves and/or feet of the user are not supported correctly, making the foot rest less comfortable to the user.

A number of adjustable leg rests for use with reclining chairs have been known previously in the art. However, in many cases these adjustable leg rests are cumbersome to use and complicated to manufacture. In addition, the adjustable leg rests that are known in the art do not lend themselves to application to previously manufactured reclining chairs, requiring that the scissor linkage mechanisms be modified or replaced to be adapted to the adjustable leg rests.

The present disclosure provides an adjustable leg rest that meets the need of the art. The adjustable foot rest assembly supports a foot rest pad and is capable of moving between a first position (where the foot rest pad is closer to the front of the reclining chair) and a second position (where the foot rest pad is farther away from the front of the chair) to adjust to the physical characteristics of a user of the chair. The adjustable leg rest is easy to use and simply to manufacture. In addition, the adjustable leg rest of the present disclosure can be retrofitted to existing reclining chairs without replacing the existing scissor linkage mechanism.

DETAILED DESCRIPTION

Figure 1:
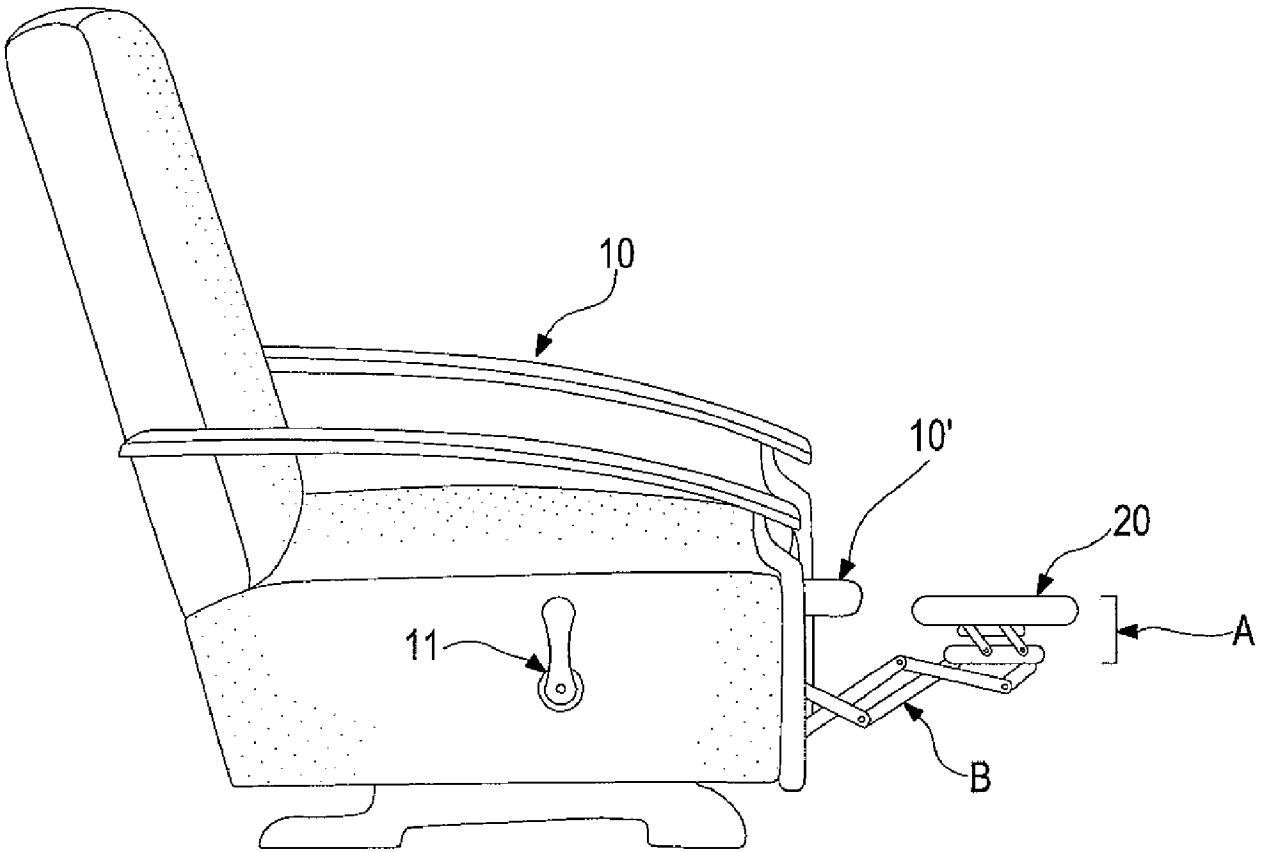
FIG. 1 shows an elevation view of one embodiment of the adjustable leg rest assembly of the present disclosure as attached to a reclining chair via a scissor linkage mechanism.

Components of the Adjustable Leg Rest Assembly

Referring to the figures, wherein like reference characters designate corresponding parts throughout the several views, one embodiment of the adjustable leg rest assembly will now be described in greater detail. In the discussion below and the figures provided the adjustable leg rest assembly is discussed and illustrated with reference to one bracket assembly of the adjustable leg rest assembly; in operation the adjustable leg rest assembly comprises a pair of spaced apart bracket assemblies. It is to be understood that the adjustable leg rest assembly of the present disclosure comprises an opposite bracket assembly that is the mirror image to the assembly illustrated and which operates in the same or corresponding manner.

The adjustable leg rest assembly is configured to be installed on standard type scissor linkage mechanisms as is known in the industry. The adjustable leg rest assembly may be installed at the factory or it may be installed in a retrofit application by the manufacturer, seller or consumer. The details of operation of the scissor linkage mechanism will not be described in detail in the present disclosure, except to the extent necessary for the understanding of the operation of the adjustable leg rest assembly described herein.

The adjustable leg rest assembly, generally designated A, comprises two bracket assemblies. Each bracket assembly comprises a first bracket 50, a second bracket 1, a leg rest pad 20 fixedly secured to the second bracket 1, a first pivoting link 51 and a second pivoting link 52. The first and second pivoting links 51 and 52 connect the first bracket 50 to the second bracket 1. The components of the adjustable leg rest assembly A will now be described in greater detail below.

Figure 2A:
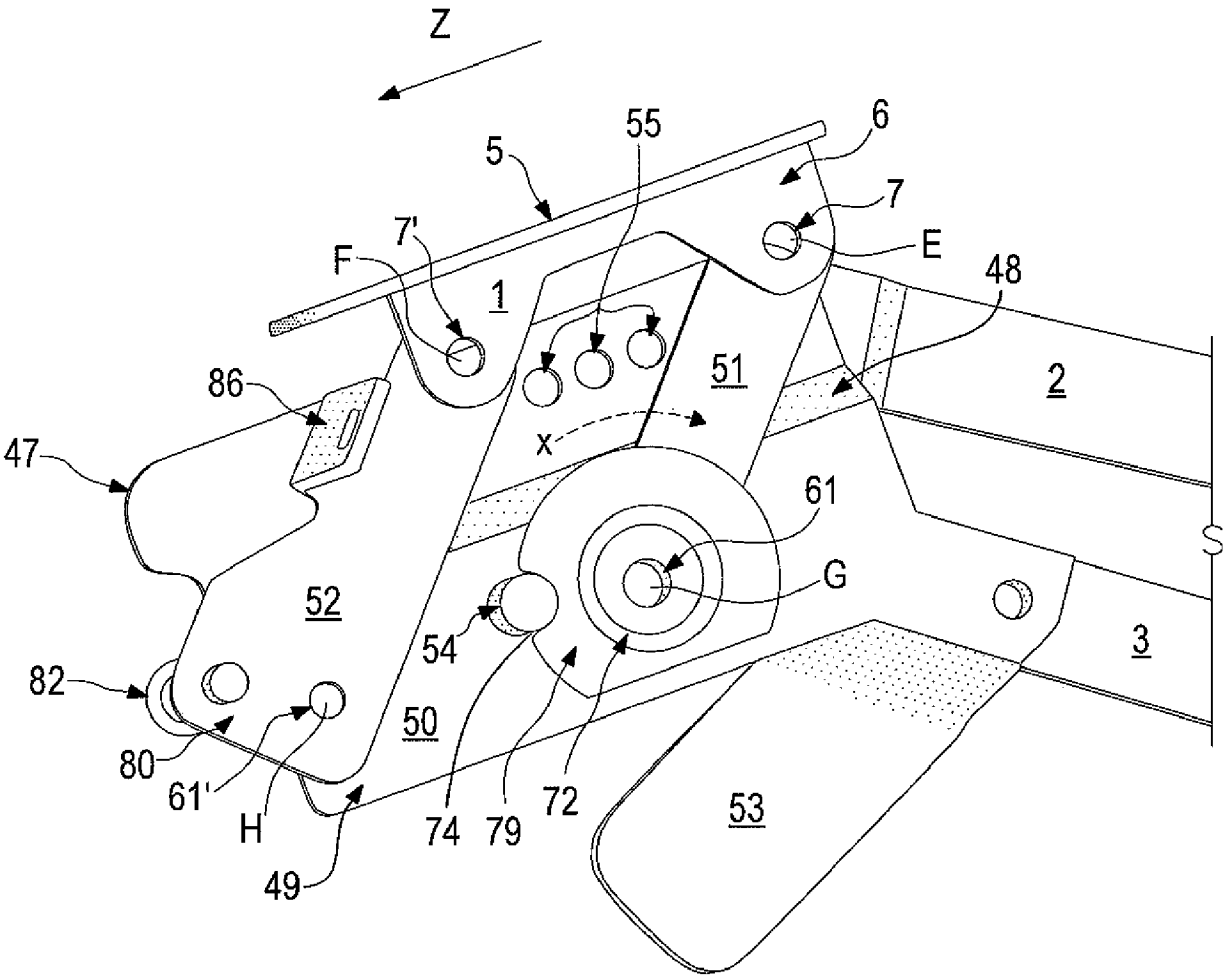
FIG. 2A shows a view of one side of one embodiment of the adjustable leg rest assembly A in the first position as viewed from the interior of the adjustable leg rest assembly A.
Figure 2B:
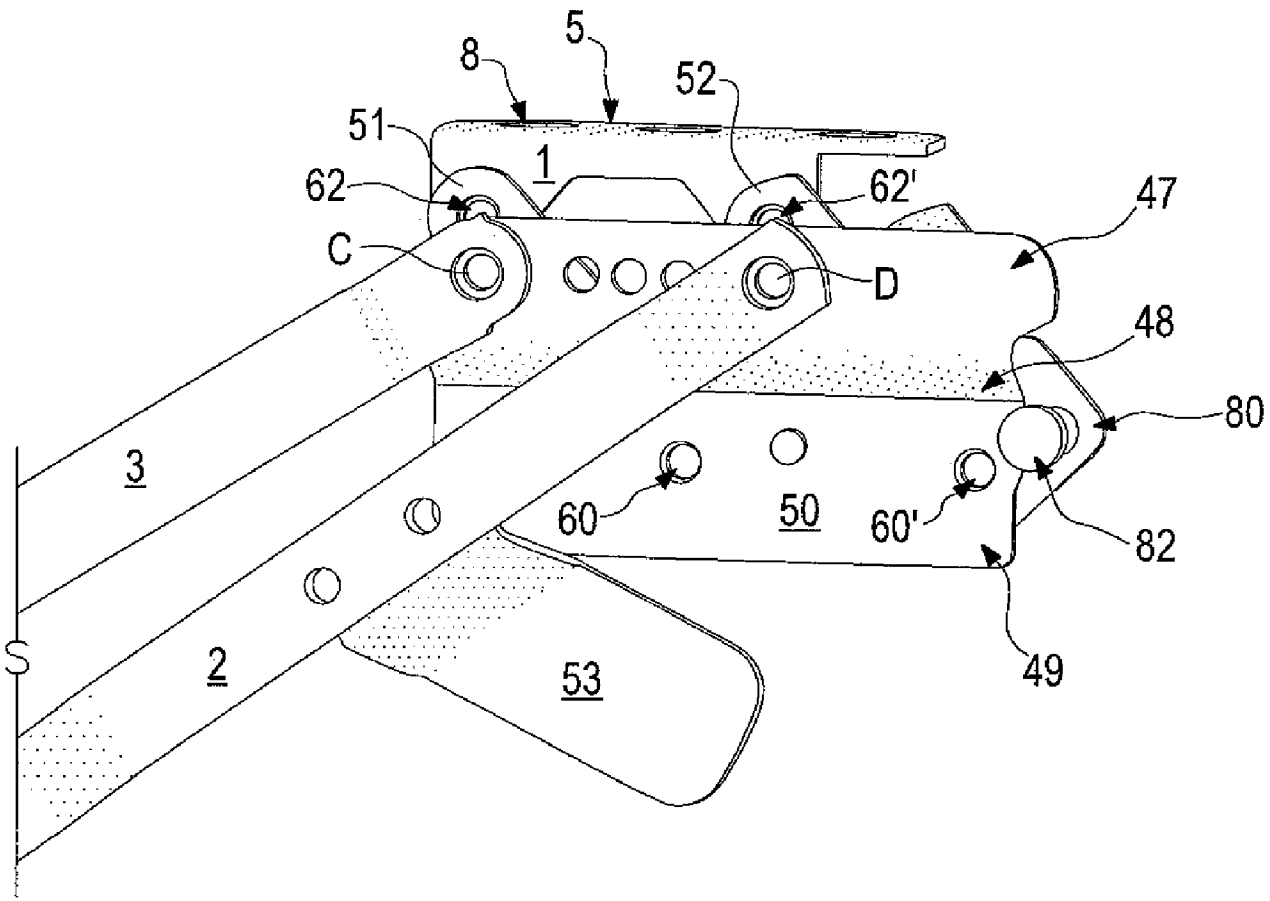
FIG. 2B shows a view of one side of one embodiment of the adjustable leg rest assembly A in the second position as viewed from the exterior of the adjustable leg rest assembly A.
Figure 3A:
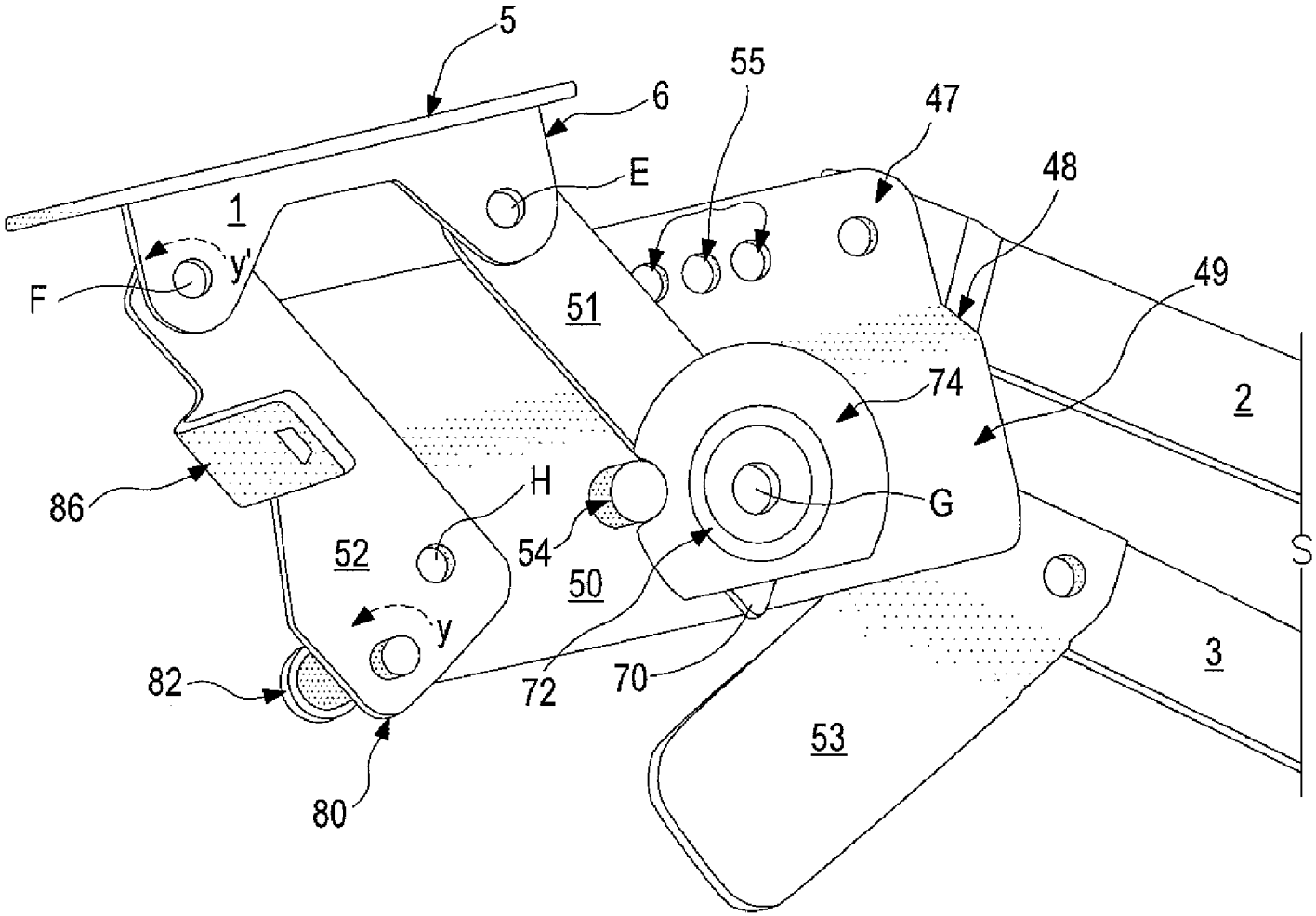
FIG. 3A shows a view of one side of one embodiment of the adjustable leg rest assembly A in the first position as viewed from the interior of the adjustable leg rest assembly A.
Figure 3B:
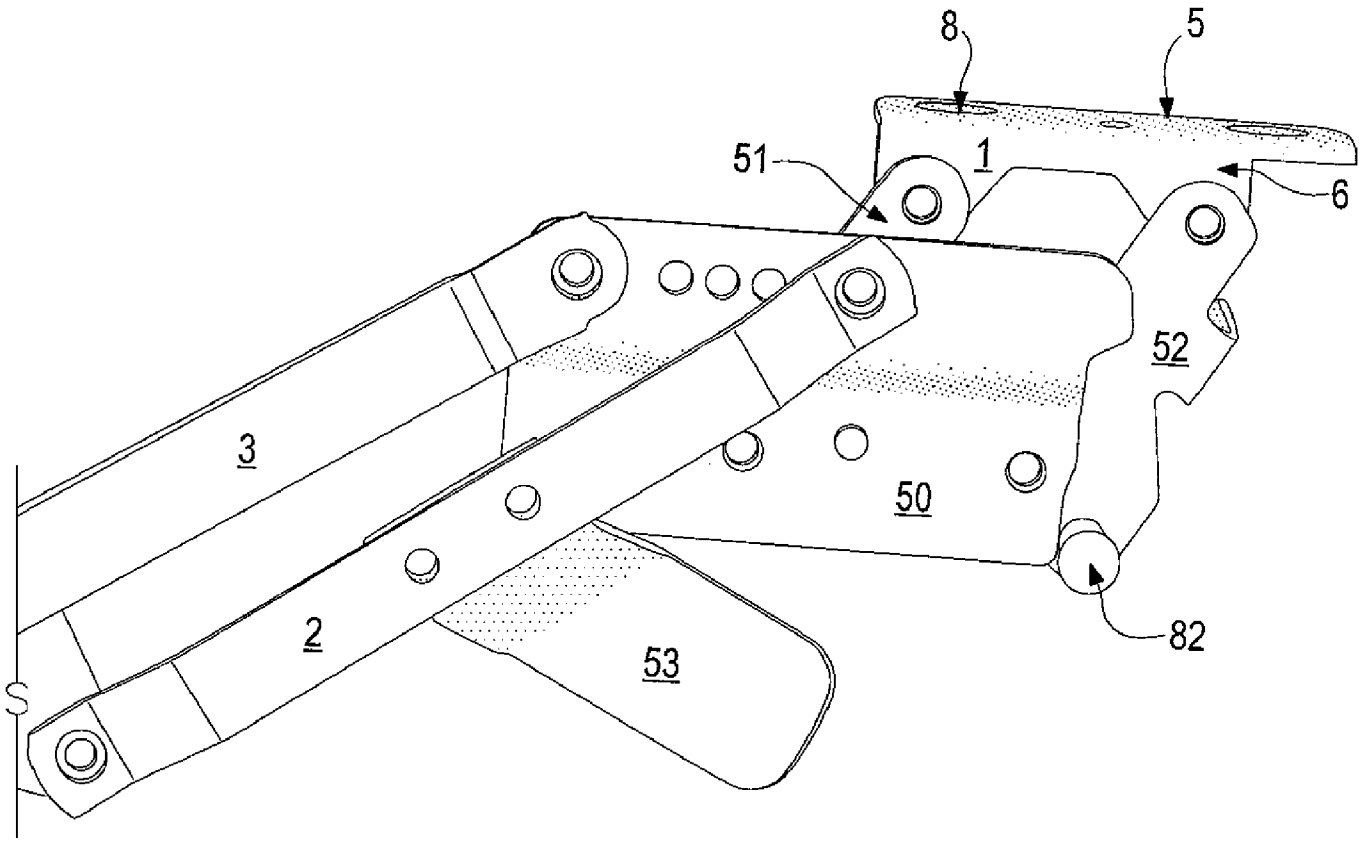
FIG. 3B shows a view of one side of one embodiment of the adjustable leg rest assembly A in the second position as viewed from the exterior of the adjustable leg rest assembly

With reference to FIGS. 2A and 2B and 3A and 3B, the first bracket 50 serves to connect the adjustable leg rest assembly A to the scissor linkage mechanism, generally designated B. The scissor linkage mechanism B is moveably connected at its opposite end to a recliner (generally designated 10) as is known in the art. The outer arms of the scissor linkage mechanism B are designated 2 and 3. In certain embodiments of the adjustable leg rest assembly A, one of the outer arms 2 or 3 may comprise a flange 53. The flange 53 functions to aid in the retraction of the adjustable leg rest assembly A as described in greater detail below. In FIGS. 2A and 3A, the flange 53 is shown fixedly secured to the outer arm 3. The first bracket 50 may be of any shape desired. In the embodiment illustrated the first bracket 50 comprises a first portion 47 and a second portion 49, said first 47 and second 49 portions being joined by a angled portion 48 (see FIGS. 2A, 2B, 3A and 3B). In the embodiment illustrated, the angled portion 48 serves to offset the second portion 49 and the other components of the adjustable leg rest assembly A from the components of the scissor linkage B (specifically the outer arms 2 and 3) while placing the first portion 47 in a position for attachment to the outer arms 2 and 3 of the scissor linkage B. The first bracket 50 further comprises a stop 54 (discussed below). In addition, the first bracket 50 may comprise one or more openings (generally labeled 55) to allow the first bracket 50 to be pivotally attached to the outer arms 2 and 3 of the scissor linkage B. As illustrated, the openings 55 are shown in the first portion 47 of the first bracket 50. In the embodiment illustrated a plurality of openings 55 are illustrated to allow for attachment to a variety of scissor linkage assemblies B. The lower portion 49 of the first bracket also comprises a plurality of openings 60 to allow the first bracket to be pivotally attached to the first 51 and second 52 pivoting links.

The first bracket 50 is pivotally attached to the outer arms 2 and 3 of the scissor linkage B via two pivot points C and D. The method of attachment is not, critical to the present disclosure and any means of attachment may be used. As illustrated in the figures, a standard bolt (generically identified as 56) is used to pivotally attach the first bracket 50 (through the openings 55) to the outer arms 2 and 3 of the scissor linkage B (through a corresponding opening in the outer arms 2 and 3). The bolt 56 has a head portion (the head portion being larger than the diameter of the opening in the outer arms 2 and 3) and a flange portion secured to the opposite end (the flange portion being larger than the diameter of the opening 55) to secure the bolt in an operational position to effect the pivotal attachment. The bolt 56 thereby creates the pivot points C and D.

Figure 4:
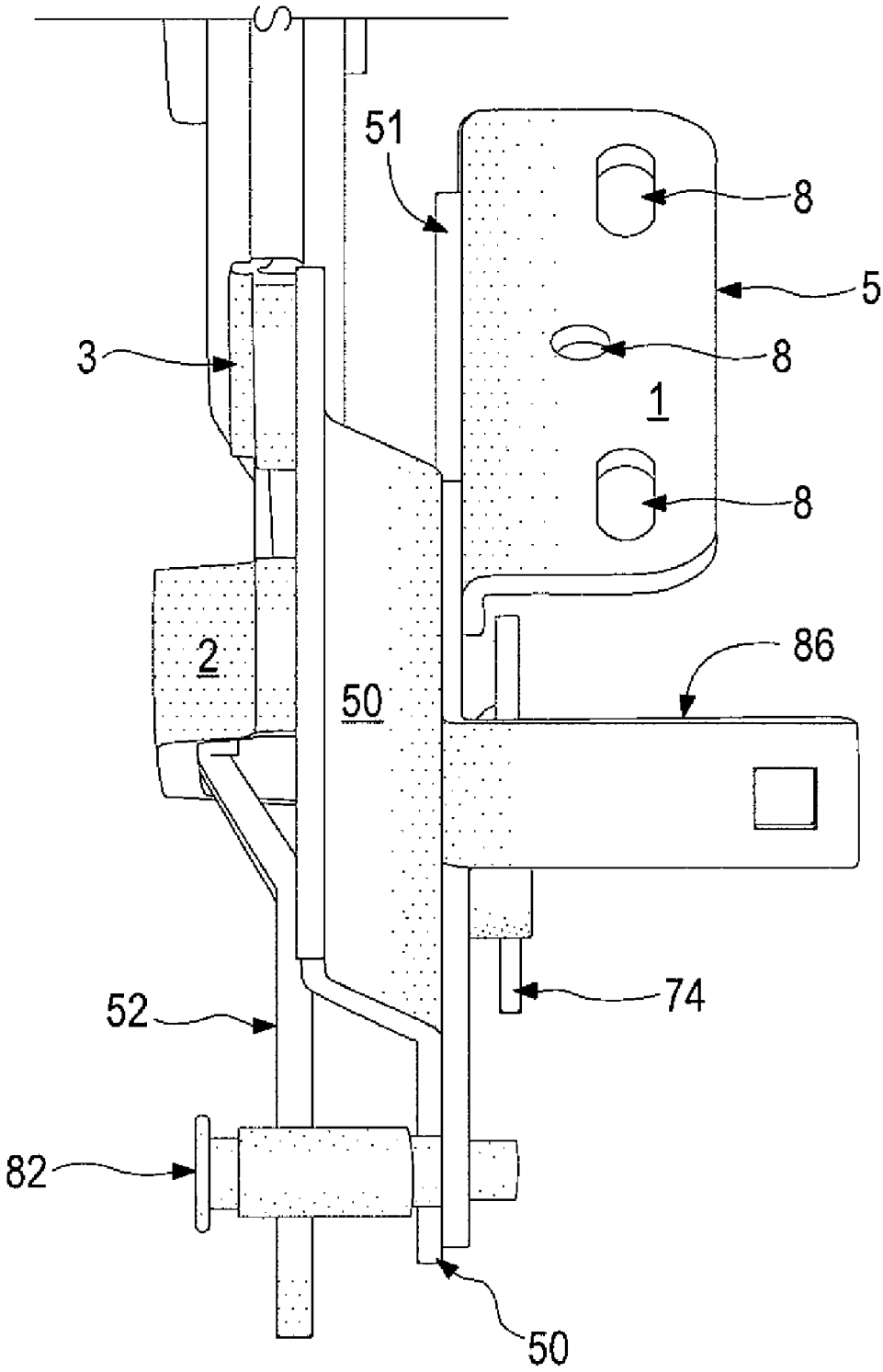
FIG. 4 shows top view of one embodiment of the adjustable leg rest assembly of the present disclosure.

The second bracket 1 serves to connect the leg rest pad 20 to the adjustable leg rest assembly A. The second bracket 1 comprises a mounting base 5 and a depending portion 6. The leg rest pad 20 is fixedly secured to the base portion 5 of the second bracket 1 and the base portion 5 may have suitable openings 8 (see FIG. 4) to effect such attachment. The leg rest pad may be affixed to the base portion 5 via any convenient means as may be known in the art (such as, but not limited to, screws). The second bracket 1 is also pivotally attached to the first 51 and second 52 pivoting links via pivot points E and F. The first bracket 1 (with the base portion 5 and the depending leg portion 6) may be of any shaped desired, with the embodiment shown in the figures being illustrative only.

The first pivoting link 51 joins the first bracket 50 to the second bracket 1. The first pivoting link 51 is pivotally attached to both the first bracket 50 via pivot point G and to the second bracket 1 via pivot point E. The first pivoting link 51 may be of any shape desired, with the embodiment illustrated in the figures being illustrative only. As illustrated best in FIGS. 2A and 3A, the first pivoting link 51 is elongate in shape and comprises a pair of openings 61 and 62 for use in the pivoting attachment of the first pivoting link 51 to the first bracket 50 and the second bracket 1. The first pivoting link 51 has an angled extension 70 depending from one end thereof opposite the attachment to the second bracket 1. The angled extension 70 further comprises a notch 72 for engaging the stop 54 during operation of the adjustable leg rest assembly A (as discussed in more detail below). A guard 74 may also be fixedly secured to the first pivoting bracket 51 as illustrated best in FIGS. 2A and 3A. The guard 74 comprises a notch 76 to engage the stop 54. The function of the guard 74 is to cover the angled extension 70, specifically the interaction of notch 72 with stop 54. In this manner, the guard 74 provides a cover for any "pinch points" that may be generated during the movement of the adjustable leg rest assembly A between the first position and the second position. The guard 74 may be of any shape desired, with the embodiment illustrated in the figures being illustrative only. The guard 74 is placed on top of the first pivoting bracket 51, and the first pivoting bracket 51 is capable of free movement about the pivot point G behind the guard 74.

The second pivoting link 52 also joins the first bracket 50 to the second bracket 1. The second pivoting link 52 is pivotally attached to both the first bracket 50 at pivot point H and to the second bracket 1 via pivot point F. The second pivoting link 52 may be of any shape desired, with the embodiment illustrated in the figures being illustrative only. As illustrated best in FIGS. 2A and 3A, the second pivoting link 52 comprises a pair of openings 61' and 62' for use in the pivoting attachment of the second pivoting link 52 to the first bracket 50 and the second bracket 1. The second pivoting link 52 comprises a shoulder 80 at one end thereof (opposite the attachment to the second bracket 1). A second stop 82 is positioned on the shoulder 80 (the function of the second stop 80 is discussed below). A bracket 86 may extend from a portion of the second pivoting link 52. The function of the bracket 86 is to receive and fixedly secure a cross support (not shown) extending between opposite sides of the adjustable leg rest assembly A to provide extra stability thereto.

As discussed above, the first pivoting link 51 and the second pivoting link 52 are secured to the second bracket 1 at pivot points E and F, respectively, and are secured to the first bracket 50 via pivot points G and H, respectively. The method of attachment is not critical to the present disclosure and any means of attachment may be used. In the embodiment described and illustrated, bolts 56 (with the features as described above) are used. With regard to pivot points E and F, a bolt 56 is passed through openings 7 and 7' in the depending portion 6 of the second bracket 1 and corresponding openings 62 and 62' on the first 51 and second 52 pivoting links, respectively, to create pivot points E and F. With regard to pivot points G and H, a bolt 56 is passed through openings 60 and 60' in the second portion 49 of the first bracket 50 and corresponding openings 61 and 61' on the first 51 and second 52 pivoting links, respectively, to create pivot points G and H In the embodiment illustrated and described, the pivot points E, F, G and H are secured to the first 50 and second 1 bracket as discussed above for the attachment of the first bracket 50 to the outer arms 2 and 3 of the scissor linkage B.

Operation of the Adjustable Leg Rest Assembly

The reclining chair 10 with scissor linkage B operates as is known in the art and standard in the industry (see FIG. 1). Briefly, a user sits in the reclining chair and activates a lever 11 (such as by pulling the lever forward) or takes some other action such that the scissor linkage B is switched from a retracted or stored position into an extended position (FIG. 1 shows the scissor linkage B in the extended position). The form of the scissor linkage B as shown in FIG. 1 is illustrative only and the scissor linkage B may have other forms as is known in the art. The outer arms 2 and 3 are pivotally secured to the first bracket 50 of the adjustable leg rest assembly A as described above through pivot points C and D. When the scissor linkage B is extended, the first bracket 50 pivots about pivot points C and D in a clockwise position such that the adjustable leg rest assembly A is generally horizontal with the surface on which the reclining chair is resting (referred to as the "in use position"). When the scissor linkage B is in the retracted position, the first bracket 50 pivots about pivot points C and D in a counter-clockwise position so that the adjustable leg rest assembly A is generally perpendicular to the surface on which the reclining chair is resting (referred to as the "storage position"). The pivot points C and D in combination with the extending action of the scissor linkage B allow the adjustable leg rest pad assembly to shift between the in use and storage positions.

When the scissor linkage B is in the extended position and the adjustable leg rest assembly A is in the in use position, the adjustable leg rest assembly A places the leg rest pad such that it can support the legs and/or feet of a user. However, as discussed above, it would be advantageous for a user to be able to adjust the leg rest pad 20 to account for his/her physical characteristics (such as height). The adjustable leg rest assembly A allows the user to adjust the position of the leg rest pad 20 without additional movement of the scissor linkage B. When the adjustable leg rest assembly A is in the in use position, the adjustable leg rest assembly A is initially in a first position as shown in FIGS. 2A and 2B. FIG. 2A shows a view of one side of the adjustable leg rest assembly A as viewed from the interior of the adjustable leg rest assembly A. FIG. 2B shows a view of one side of the adjustable leg rest assembly A as viewed from the exterior of the adjustable leg rest assembly A. In the first position (see FIG. 2A), the first 51 and second 52 pivoting links are rotated about pivot points G and H, respectively, in the direction of arrow X (which for the purpose of this disclosure is defined as clockwise) placing the second bracket 1 with the attached leg rest pad 20 in its closest position to the front portion 10' of the reclining chair 10. The first pivoting link 51 is restrained from further movement in the direction of arrow X through contact with the stop 54. The stop 54 engages the notch 72 on the angled extension 70 to inhibit further travel in the direction of arrow X. As discussed above, guard 74 covers any pinch points that may be created by this interaction.

If the user desires to switch the adjustable foot rest assembly A to the second position, the user applies gentle force to the adjustable leg rest assembly A (such as by pushing on the leg rest pad 20) in the direction of arrow Z (see FIG. 3A). In the second position the second bracket 1 with the attached leg rest pad 20 is in the farthest position away from the front portion 10' of the reclining chair 10. As force is applied to the adjustable leg rest assembly A in the direction of arrow Z, the first 51 and second 52 pivoting links rotate about pivot points G and H, respectively, in the direction of arrow Y (which for the purpose of this disclosure is defined as counter-clockwise) and about pivot points E and F, respectively, in the direction of arrow Y' (see FIG. 3A). The travel of the adjustable leg rest assembly A in the direction of arrow Y and Y' is restrained by the interaction of the second stop 82 with the second portion 49 of the first bracket 50 (best illustrated in FIG. 3B).

The adjustable leg rest assembly A can be switched from the second position back to the first position by applying pressure to the adjustable foot rest assembly A in a direction opposite that of arrow Z. The actions described above are reversed. The first 51 and second 52 pivoting links rotate about pivot points G and H, respectively, and pivot points E and F, respectively, in a clockwise direction until the adjustable leg rest assembly reaches the first position. The travel of the adjustable foot rest A is restrained by the interaction of stop 54 with the notch 72 of the angled extension 70 of the first pivoting link 51 as discussed herein.

The scissor linkage B can be retracted to return the adjustable leg rest assembly A to the stored position when the adjustable leg rest assembly A is in the first position or the second position. If the adjustable leg rest assembly A is in the first position, the retraction of the scissor linkage B urges the adjustable leg rest assembly downward so that it is no longer in a horizontal position with respect to the surface on which the reclining chair is resting and causes the first bracket 50 to rotate about pivot points C and D in a counter-clockwise direction as the scissor linkage B is retracted. The second stop 82 aids in the retraction process by contacting flange 53 on its upper surface 53'. In the final stored position, the adjustable leg rest assembly A is generally perpendicular to the surface on which the reclining chair is resting. If the adjustable leg rest assembly A is in the second position, the retraction of the scissor linkage B urges the adjustable foot rest assembly A downward so that it is no longer in a horizontal position with respect to the surface on which the reclining chair is resting. As the adjustable leg rest assembly A continues this downward movement, the second stop 82 engages flange 53, which is fixedly positioned on one of the outer arms of the scissor linkage B (see FIGS. 2A and 3A). The second stop 82 is extended in length such that the second stop 82 is capable of making contact with the flange 53. As the second stop 82 engages flange 53, the second stop 82 travels along the front edge 53' of the flange 53. In this manner flange 53 applies pressure on the second stop 82 which is transmitted to the adjustable leg rest assembly A. This pressure causes the first 51 and second 52 pivoting links to pivot about pivot points G and H, respectively and pivot points E and F, respectively, in the clockwise direction such that the adjustable leg rest assembly is returned to the first position. The scissor linkage B then retracts as described above.

The foregoing description illustrates and describes certain embodiments of the present disclosure. It is to be understood that the teachings of the present disclosure are capable of use in various other combinations, modifications, and environments and is capable of changes or modifications within the scope of the concept as expressed herein, commensurate with the above teachings and/or the skill or knowledge of the relevant art. The embodiments described hereinabove are further intended to explain best modes known of practicing the disclosure and to enable others skilled in the art to utilize the same or other embodiments and with the various modifications required by the particular application or use. Accordingly, the description is not intended to limit the invention to the embodiments disclosed herein. All references cited herein are incorporated by reference as if fully set forth in this disclosure.

What is claimed is:

1. An adjustable leg-rest assembly for use with a reclining chair, said leg-rest assembly comprising a first bracket pivotally secured to a scissor linkage assembly, said scissor linkage assembly capable of alternating said adjustable leg-rest assembly between an in use position when said scissor linkage assembly is extended and a storage position when said scissor linkage assembly is retracted, a second bracket, secured to and supporting a leg-rest pad, a first pivoting link and a second pivoting link, said first and second pivoting links pivotally connecting said first and second brackets, said first and second pivoting links allowing said second bracket to reversibly move between a first position and a second position when said scissor linkage assembly is extended, the first position placing the leg rest pad a first distance from a front portion of the reclining chair and the second position placing the leg rest pad a second distance from the front portion of the reclining chair, the second distance being greater than the first distance.

2. The leg-rest assembly of claim 1 where said first bracket comprises a first portion, a second portion and an angled portion, said angled portion joining said first and second portions and creating an offset of said second portion from said first portion to allow the attachment of the first portion to said scissor linkage assembly.

3. The leg-assembly of claim 2 where said second pivoting link comprises a shoulder portion said shoulder portion supporting a second stop, said second stop interacting with said second portion of said first bracket to limit the travel of the second pivoting link and placing said leg-rest pad in said second position.

4. The leg-rest assembly of claim 3 further comprising a flange secured to said scissor linkage assembly, said flange aiding the placement of said leg-rest assembly in said storage position when said leg-rest assembly is in said first position and said scissor linkage assembly is retracted.

5. The leg-rest assembly of claim 4 where said leg-rest assembly is urged downwards by said scissor linkage assembly whereby said second stop contacts said flange and thereby aids in the placement of said leg-rest assembly in said storage position.

6. The leg-rest assembly of claim 3 further comprising a flange secured to said scissor linkage assembly, said flange aiding the placement of said leg-rest assembly in said storage position when said leg-rest assembly is in said second position and said scissor linkage assembly is retracted.

7. The leg-rest assembly of claim 6 where said leg-rest assembly is urged downwards by said scissor linkage assembly whereby said second stop contacts said flange, applying a pressure to said second stop and said leg-rest assembly, said pressure causing the second bracket to rotate on said first and second pivoting links in a clockwise direction thereby moving said leg-rest assembly to said first position.

8. The leg-rest assembly of claim 1 where said first position is a position where said leg rest pad is in a retracted position and where said second position is a position where said leg rest pad is in an extended position.

9. The leg rest assembly of claim 1 where a user moves said leg rest pad from the first position to the second position by applying a force to said leg-rest pad in a direction away from said scissor linkage.

10. The leg-rest assembly of claim 9 where said force is applied by a foot of a user.

11. The leg rest assembly of claim 1 where a user moves said leg rest pad from the first position to the second position by applying a force to said leg-rest pad in a direction toward said scissor linkage.

12. The leg-rest assembly of claim 11 where said force is applied by a foot of a user.

13. The leg-rest assembly of claim 1 where in said in use position the leg rest pad is generally horizontal to a surface on which said reclining chair is resting.

14. The leg-rest assembly of claim 1 where in said storage position the leg rest pad is generally perpendicular to a surface on which said reclining chair is resting.

15. The leg-rest assembly of claim 1 where said first bracket further comprises a stop and said first pivoting link comprises a notch to interact with said stop, the interaction of said notch and said stop limiting the travel of said first pivoting link and placing said leg rest pad in said first position.

16. The leg-rest assembly of claim 15 further comprising a guard secured to the first pivoting link, said guard covering the interaction of said notch and said stop.

17. The leg-rest assembly of claim 16 where said guard covers a pinch point produced by the interaction of said notch and said stop.

18. The leg-rest assembly of claim 17 where said guard comprises a second notch interacting with said stop.

* * * * *